United States Patent [19]

Wakaeya et al.

[11] Patent Number: 5,050,313

[45] Date of Patent: Sep. 24, 1991

[54] DRYER AND METHOD FOR CONTROLLING THE OPERATION THEREOF

[75] Inventors: Shinji Wakaeya; Shozo Shionome, both of Kawasaki; Moritaka Ohta; Masatoshi Shimbashi, both of Matto, all of Japan

[73] Assignees: Fuji Electric Co., Ltd., Kawasaki; Inamoto Manufacturing Co., Ltd., Matto; Toyo Menka Kaisha, Ltd., Osaka, all of Japan

[21] Appl. No.: 569,390

[22] Filed: Aug. 15, 1990

Related U.S. Application Data

[62] Division of Ser. No. 259,245, Oct. 18, 1988, abandoned.

[30] Foreign Application Priority Data

| | | | |
|---|---|---|---|
| Oct. 20, 1987 | [JP] | Japan | 62-265102 |
| Apr. 12, 1988 | [JP] | Japan | 63-89448 |
| Apr. 27, 1988 | [JP] | Japan | 63-105067 |

[51] Int. Cl.[5] ..... F26B 21/06

[52] U.S. Cl. ..... 34/27; 34/46; 34/48; 34/50

[58] Field of Search ..... 34/31, 34, 46, 48, 50, 34/53, 55, 26, 27, 30

[56] References Cited

U.S. PATENT DOCUMENTS

| | | | |
|---|---|---|---|
| 4,112,589 | 9/1978 | Palfrey et al. | 34/48 |
| 4,206,552 | 6/1980 | Pomerantz et al. | 34/23 |
| 4,338,730 | 7/1982 | Tatsumi et al. | 34/54 |
| 4,386,471 | 6/1983 | Bowrey et al. | 34/26 |
| 4,412,389 | 11/1983 | Kruger | 34/46 |
| 4,644,665 | 2/1987 | Naunapper et al. | 34/48 X |
| 4,704,805 | 11/1987 | Kaya et al. | 34/48 |
| 4,733,479 | 3/1988 | Kaji et al. | 34/48 |

*Primary Examiner*—Harry B. Tanner

*Attorney, Agent, or Firm*—Spencer & Frank

[57] ABSTRACT

A dryer has a container holding goods to be dried, suction and exhaust ducts communicating with the container, a blower forcibly blowing air through the suction duct, the container and the exhaust duct and a heater for heating air flowing through the suction duct. An absolute humidity sensor is provided to measure a degree of absolute humidity in exhaust air flowing through the exhaust duct. Drying generation of the dryer is interrupted when a measured degree of absolute humidity of the exhaust air and a degree of absolute humidity in the surrounding air has a predetermined relationship.

8 Claims, 13 Drawing Sheets

DRYER AND METHOD FOR CONTROLLING THE OPERATION THEREOF

This application is a division of application Ser. No. 07/259,245, filed Oct. 18th, 1988, abandoned.

BACKGROUND OF THE INVENTION

1. Field of the Invention

The present invention relates to a dryer for drying various textile goods such as clothes and the like and a method for controlling drying operation thereof and more particularly to, for instance, a rotary-drum (tumbling barrel type) dryer for drying clothes and a method best adapted for controlling drying operation thereof.

2. Description of the Prior Art

In rotary drum dryers for clothes widely used in the cleaning industry, dried air is caused to pass through a rotary drum by an air blower to dry clothes. A peripheral wall of the rotary drum is formed with a great number of pores so that suction air heated by a heat exchanger passes through such pores into the rotary drum and resulting humidified air is discharged through an exhaust duct.

Conventional methods for controlling drying operations of dryers of the type described above are generally divided into the following four types:

1) Time control method for setting a drying time by a timer (as, for instance, disclosed in U.S. Pat. No. 4,338,730);
2) Temperature control method for determining whether the textile goods have been satisfactorily dried or not in response to a predetermined temperature or to variations in temperature (as, for instance, disclosed in U.S. Pat. No. 4,206,552);
3) A method consisting of a combination of the time control method 1) and the temperature control method 2) (as disclosed in, for instance, U.S. Pat. No. 4,412,389); and
4) Humidity control method for controlling operation of a dryer in response to detection of relative humidity (as, for instance, disclosed in U.S. Pat. No. 4,386,471).

Next, problems encountered in the above-described conventional dryer control methods will be described below.

1) Problems of the time control method with a timer

According to this method, drying operation is controlled only in response to a predetermined time interval so that in principle depending upon materials and variations in weight of goods to be dried, the a degree of dehydration of goods to be dried before they are charged into the dryer and variations in other environmental conditions such as the weather, the drying time interval must be varied case by case. In this case, a setting of a drying time interval is based on experience and the instinct of an operator so that it is almost impossible to determine an optimum time interval so as to attain a predetermined degree of dryness of dried goods.

It follows, therefore, that the above method has a problem that in order to completely dry textile goods, an operation time is usually preset longer than a drying time required for completely drying the textile goods, so that an extra amount of energy is unnecessarily wasted. Furthermore, after the drying process, the dried textile goods undergo the ironing process in some cases. In the case that the dried textile goods are required to have an optimum humidity of the order of, for instance, 30%, there also arises a problem that the dried textile goods vary in a degree of dryness.

2) Problems of the temperature control method utilizing a temperature sensor

In the case of dryers of the type in which the high-temperature air is blown against goods to be dried such as clothes charged into a rotary drum after they are dehydrated, experiments show that a temperature characteristic of discharged air after having passed through the goods to be dried is in general divided into the following three time intervals.

That is, the first time interval or preheating time period immediately after charging the goods to be dried which are wet and at low temperatures is a preheating time interval during which the goods to be dried and interior parts of a dryer must be raised in temperature; that is, in the first time interval during which a temperature rise is fast, thermal energy from a heat source is consumed only to raise the temperature and does not dry the goods. The above preheating time period is then followed by a constant ratio drying time interval during which water contained in the goods to be dried is constantly being evaporated so that the thermal energy from the heat source is used for the heat of vaporization of the moisture in the goods and consequently the temperature rise in the constant ratio drying time interval is slower than that in the preheating time interval or is substantially constant. In a last time interval following the constant ratio drying time interval, part of the thermal energy from the heat source is used as the heat of vaporization, for moisture still in the goods while the remaining thermal energy serves to raise the temperature, so that depending upon the quantity of water remaining in the goods being dried, the temperature rise curve changes from a slow temperature rise rate to an increasingly quicker temperature rise rate.

As described above, there exists a qualitative relationship between a degree of dryness of the goods to be dried and the temperature. As shown in FIG. 2, if the temperature is preset at a level slightly higher than a temperature-rise change point during the intermediate and last time intervals described above, the temperature characteristic as indicated by the curve a is observed when weight of goods to be dried is light and the temperature characteristic as indicated by the curve c is observed when weight of the goods to be dried is heavy, due to variations in weight of goods to be dried. The above-described temperature characteristics have been confirmed by experiments. The temperature control method has an excellent ability to automatically change a drying time interval in response to variations in weight of goods to be dried as compared with the time control method 1) utilizing a timer. However, this effect is only qualitative. It is limited to quantitatively control uniformity and reproducibility of dried goods, because temperature characteristics depend on materials of the goods to be dried and other environmental conditions such as the weather.

3) Problems of the control method consisting of a combination of the time control method and the temperature control method As described in 2), the temperature control method can attain satisfactory results when materials of the goods to be dried and environmental conditions can be maintained within a predetermined range, but when the above-described conditions are not satisfied, problems arise. Therefore, the control method in which the temperature control method is connected in series to the time control method or the temperature control method and the time control method are carried out in parallel has been devised and demonstrated. However, even the combination method cannot fundamentally solve the problem that the qualities of the dried goods must be improved and a degree of dryness of the dried goods must be maintained uniform.

4) Problems of the humidity include the following control method in response to a detected relative humidity Unlike the above-described three control methods in which a degree of dryness of the goods to be dried is controlled in response to an indirect parameter such as a time interval in the time control method 1), a temperature in the temperature control method 2) and a time interval and a temperature in the combination method 3), respectively, the humidity control method controls a degree of dryness of the goods to be dried in response to a direct parameter, namely relative humidity so that the problems described above in 1), 2) and 3) can be considerably improved.

However, the humidity control method has a problem in that a desired degree of dryness cannot be attained when the goods to be dried are lighter in weight than the rated weight, e.g. in business type dryers in which in order to attain a high drying capacity, high-temperature air is utilized as a heat source so as to shorten a required drying time interval.

Recently, especially in the linen supply industry, there is an increasing demand for drying a large quantity of goods which vary in material and in weight within a short time period in such a way that qualities of dried goods can be maintained uniformly. And in many cases, the dryer must be operated with a load less than the rated weight whenever kinds of linen vary. However, there exists a in that the goods are not always dried to a satisfactory degree of dryness.

The causes of the foregoing problems encounted in the method for controlling the dryer in response to a detected relative humidity will be described below with reference to FIG. 3.

In FIG. 3, the curve a represents the temperature of discharged air as a function of drying time when weight of the goods to be dried is less than the rated weight, and shows that a temperature rise is very sharp as compared with the temperature curve b when the dryer is operated at its rated weight. The temperature curve b has a relatively flat portion which indicates that the temperature is maintained at a stabilized level, but the temperature curve a indicates that there is no stabilized temperature period because part of the high-temperature air is directly discharged out of the dryer without passing through the goods to be dried therein, so that the temperature rise continues.

Meanwhile the curve c indicates relative humidity when weight of the goods to be dried is equal to the rate weight, while the curve e represents relative humidity when weight of the goods to be dried is less than the rated weight. Relative humidity is defined as a ratio of partial water vapor pressure in air to saturation water vapor pressure at the given temperature so that even when the partial pressure is maintained at the same level, relative humidity drops as the temperature rises.

When the goods to be dried are lighter in weight than the rated weight the temperature rises quickly as indicated by the curve a so that the relative humidity curve e quickly drops at a rate faster than the drying rate of the goods to be dried and reaches a predetermined relative humidity faster than by a time interval (td–te) as compared with an optimum relative humidity curve d shown by a dash line (which cannot be plotted based upon actual results or measurements and therefore is an imaginary curve) when the weight of the goods to be dried is lighter than the rated weight. As a result, the drying operation period becomes shorter so that the goods are not dried to a satisfactory degree of dryness.

Furthermore, the cause of such problems will be described with reference to FIG. 4 showing a temperature-humidity characteristic diagram.

In FIG. 4, a shows a shift trace in the temperature-humidity characteristic diagram when the goods to be dried are equal in weight to the rated weight while b indicates a shift trace when the weight of the goods to be dried is less than the rated weight. With the weight of the goods to be dried is equal to the rated weight, the drop rate of absolute humidity of discharged air, which has a direct correlationship with a degree of dryness of the goods, is substantially equal to the drop rate of relative humidity of the discharged air so that it is seen that even when the drying operation is controlled in response to a detected relative humidity satisfactorily dried goods can not always be obtained. On the other hand, when the weight of goods to be dried is less than the rated weight, even though the absolute humidity drops only slightly, only the relative humidity drops quickly so that the goods are not dried to a desired degree of dryness.

Furthermore, according to the method for controlling a dryer in response to a detected relative humidity, satisfactorily dried goods cannot be obtained because of its relationship with environmental humidity and there is a danger that when humidity of the surrounding atmosphere is very high, a degree of humidity of the discharged air at which drying operation is stopped is set at a level lower than the humidity of the surrounding air, resulting in the problem that the operation of the dryer continues incessantly.

SUMMARY OF THE INVENTION

In view of the above, a primary object of the present invention is to provide an improved dryer and a method for controlling the operation thereof, to substantially solve the above and other problems encountered in the conventional dryers and control methods therefor.

Another object of the present invention is to provide a dryer and a method for controlling the operation thereof which can correctly detect a degree of dryness of textile goods or the like in the dryer, thereby interrupting the operation of the dryer.

A further object of the present invention is to provide a dryer and a method for controlling the operation thereof which can dry the textile goods such as clothes within a short period of time in response to the weight and materials of the textile goods such as clothes to be dried, thereby attaining the energy saving.

In the first aspect of the present invention, a dryer comprises:

a container for holding goods to be dried therein;

a suction duct and an exhaust duct both of which are communicated with the container;

means for blowing the surrounding air through the suction duct, the container and the exhaust duct in the order named;

means for heating air flowing through the suction duct;

means for measuring a degree of absolute humidity in exhaust air flowing through the exhaust duct at a predetermined time interval; and means for controlling the heating means in response to the degree of absolute humidity in exhaust air measured by the absolute humidity measuring means.

In the second aspect of the present invention, a dryer comprises:

a container for holding goods to be dried therein;

a suction duct and an exhaust duct both of which are communicated with the container;

means for blowing the surrounding air through the suction duct, the container and the exhaust duct in the order named;

means for heating air flowing through the suction duct;

means for measuring a degree of absolute humidity in exhaust air flowing through the exhaust duct at a predetermined time interval;

means for measuring a degree of absolute humidity in the surrounding air;

means for comparing the degree of absolute humidity in exhaust air measured by the absolute humidity measuring means with the degree of absolute humidity in the surrounding air measured by the surrounding air humidity measuring means; and means for interrupting drying operation of the dryer when a comparison result output derived from the comparison means has a predetermined relationship.

Here, a dryer may further comprise means for controlling a quantity of heat released from the heating means in response to a differentiated value of the degree of absolute humidity in the exhaust air measured at a predetermined time interval by the exhaust air absolute humidity measuring means or to a difference between a present degree of absolute humidity and a degree of absolute humidity measured at an immediately preceding measuring time point.

A dryer may further comprise means for controlling a quantity of heat released from the heating means and a quantity of air blown by the blowing means in response to a differentiated value of the degree of absolute humidity in the exhaust air measured at a predetermined time interval by the exhaust air absolute humidity measuring means or to a difference between a present degree of absolute humidity and a degree of absolute humidity measured at an immediately preceding measuring time point.

In the third aspect of the present invention, a dryer comprises:

a container for holding goods to be dried therein;

a suction duct and an exhaust duct both of which are in communication with the container;

means for blowing the surrounding air through the suction duct, the container and the exhaust duct in the order named;

means for heating air flowing through the suction duct;

means for measuring a degree of absolute humidity in exhaust air flowing through the exhaust duct at a predetermined time interval;

means for presetting a predetermined value of absolute humidity;

means for comparing the degree of absolute humidity in the exhaust air measured by the absolute humidity measuring means with the predetermined value of absolute humidity; and means for interrupting drying operation of the dryer when a comparison result output derived from the comparison means has a predetermined relationship.

Here, a dryer may further comprise means for determining a drop of decreasing rate of absolute humidity measured by the absolute humidity measuring means; and means for correcting the predetermined value of absolute humidity to a value higher than absolute humidity in the surrounding air in response to an output signal derived from the drop determining means.

A dryer may further comprise means for determining a drop of decreasing rate of absolute humidity measured by the absolute humidity measuring means; and means for interrupting drying operation of the dryer in response to an output signal derived from the drop determining means.

A dryer may further comprise means for detecting temperature in exhaust air flowing through the exhaust duct; and means, responsive to an output temperature signal derived from the temperature detecting means, for controlling the heating means in such a way that a temperature of the goods being dried is prevented from rising in excess of a maximum allowable temperature.

A dryer may further comprise means for detecting temperature in exhaust air flowing through the exhaust duct; and means, responsive to an output temperature signal derived from the temperature detecting means, for controlling the heating means in such a way that a temperature of the goods being dried is prevented from rising in excess of a maximum allowable temperature.

A dryer may further comprise means for detecting temperature in exhaust air flowing through the exhaust duct; and means, responsive to an output temperature signal derived from the temperature detecting means, for controlling the heating means in such a way that a temperature of the goods being dried is prevented from rising in excess of a maximum allowable temperature.

In the fourth aspect of the present invention, a method for controlling operation of a dryer of the type comprising a container for holding goods to be dried therein; a suction duct and an exhaust duct both of which are communicated with the container; an air blower for forcing the surrounding air to flow through the container; a heater for heating suction air; and means for measuring a degree of absolute humidity in exhaust air flowing through the exhaust duct, comprises the steps of:

measuring a degree of absolute humidity in the exhaust air by the absolute humidity measuring means during operation of the dryer at predetermined time interval; and controlling the heating means in response to the degree of absolute humidity in the exhaust air measured by the absolute humidity measuring means.

In the fifth aspect of the present invention, a method for controlling operation of a dryer of the type comprising a container for holding goods to be dried therein; a suction duct and an exhaust duct both of which are communicated with the container; an air blower for forcing the surrounding air to flow through the container; a heater for heating suction air; and means for measuring a degree of absolute humidity in exhaust air flowing through the exhaust duct, comprises the steps of:

measuring a degree of absolute humidity in the exhaust air by the absolute humidity measuring means during operation of the dryer at predetermined time interval; and interrupting drying operation of the dryer when a measured degree of absolute humidity in the exhaust air and a degree of absolute humidity in the surrounding air have a predetermined relationship.

Here, a method for controlling operation of a dryer may further comprise:

a step for controlling a quantity of heat released from the heater in response to a differentiated signal obtained by executing differentiation of the measured degree of absolute humidity or to a difference signal between the measured degree of absolute humidity and a degree of absolute humidity measured at an immediately preceding measuring time point.

A method for controlling the operation of a dryer may further comprise:

a step for controlling a quantity of heat released from the heater and a quantity of air blowed by the blower.

In the sixth aspect of the present invention, a method for controlling operation of a dryer of the type comprising a container for holding goods to be dried therein, a suction duct and an exhaust duct both of which are communicated with the container, an air blower for forcing the surrounding air to flow through the container, a heater for heating suction air and means for measuring a degree of absolute humidity in exhaust air flowing through the exhaust duct, comprises the steps of:

measuring a degree of absolute humidity in the exhaust air by the absolute humidity measuring means at a predetermined time interval; and interrupting drying operation of the dryer when the measured degree of absolute humidity and a predetermined value of absolute humidity come to have a predetermined relationship.

Here, a method for controlling operation of a dryer may further comprise the steps of:

determining a drop of decreasing rate of absolute humidity measured by the absolute humidity measuring means; and automatically correcting the predetermined value of absolute humidity to a value higher than absolute humidity in the surrounding air in response to an output signal derived from the drop determining step.

A method for controlling operation of a dryer may further comprise:

a step for determining a drop of decreasing of absolute humidity measured by the absolute humidity measuring means; and a step for interrupting the operation of the dryer in response to an output signal derived from the drop determining step.

A method for controlling operation of a dryer may further comprise:

a step for measuring temperature of the goods to be dried; and a step for controlling the heater in response to an output temperature signal derived from the temperature measuring step in such a way that the temperature of the goods being dried is prevented from rising in excess of a maximum allowable temperature.

A method for controlling the operation of a dryer may further comprise:

a step for measuring temperature of the goods to be dried; and a step for controlling the heater in response to an output temperature signal derived from the temperature measuring step in such a way that the temperature of the goods being dried is prevented from rising in excess of a maximum allowable temperature.

A method for controlling the operation of a dryer may further comprise:

a step for measuring temperature of the goods to be dried; and a step for controlling the heater in response to an output temperature signal derived from the temperature measuring step in such a way that the temperature of the goods being dried is prevented from rising in excess of a maximum allowable temperature.

According to the present invention, therefore, the goods to be dried can be prevented from being overdried, but can be dried to a predetermined degree of dryness and a command for stopping the drying operation when the relationship between the detected absolute humidity and the absolute humidity in the surrounding air or a predetermined value of absolute humidity reaches a predetermined value or relationship so that no variation in degree of dryness of the goods dried result and the drying operation can be accomplished within a short period of time without consuming any excess energy.

According to another aspect of the present invention, in addition to the control of the drying operation in response to detected absolute humidity, the control of the drying operation is also carried out in response to the output signal from a temperature sensor for detecting the temperature of the goods being dried so that the goods can be satisfactorily dried without being damaged and also the service lifetime of the dried goods can be increased.

Furthermore, according to the operation control method in which the drop of decreasing rate of absolute humidity detected by an absolute humidity sensor or hygrometer is determined and when the detected absolute humidity in the surrounding air is determined to be higher than a set value of absolute humidity, the set value of absolute humidity is corrected to a value higher than the absolute humidity in the surrounding atmosphere by a set-value correction unit or a command for forcibly interrupting the drying operation is outputted so that a problem that the drying operation cannot be interrupted when the preset absolute humidity is lower than that in the surrounding atmosphere can be solved. That is, according to the present invention, only by presetting a value of absolute humidity in the discharged air in accordance with the materials of the goods to be dried can the goods can be dried to a desired or satisfactory degree of dryness without being adversely affected by variations in weight of the goods to be dried, variation in degree of water content in the goods to be dried after undergoing the preceding water extraction process and variations in environmental conditions such as the weather.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
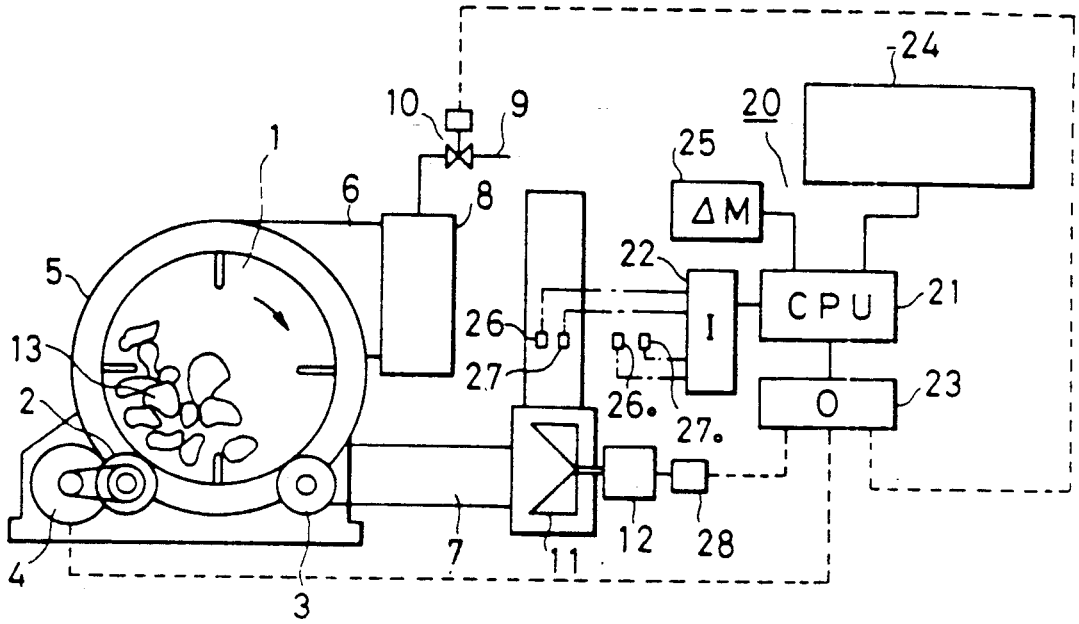
FIG. 1 is a schematic view of a first embodiment of a dryer in accordance with the present invention.

Referring first to FIG. 1 illustrating a first preferred embodiment of a dryer in accordance with the present invention, reference numeral 1 represents a rotary drum; 2 and 3, supporting rollers which support the rotary drum; 4, an electric motor for driving the rotary drum 1 through the supporting roller 2; 5, an outer barrel of the dryer; 6, a suction duct; 7, a discharge or exhaust duct; 8, a heat exchanger disposed at and communicated with an inlet of the suction duct 6; 9, a steam pipe communicated with the heat exchanger 8; 10, a flow control valve (to be referred to as "a steam valve" hereinafter in this specification) inserted in the steam pipe 9; 11, a blower communicated with the exhaust duct 7; 12, an electric motor for driving the blower 11; 20, a control device; 21, a CPU; 22, an input interface; 23, an output interface; 24, a memory or storage device; 25, a presetting device in the form of, for instance, a keyboard; 26 and 26*o*, humidity sensors; 27 and 27*o*, temperature sensors; the sensors 26 and 27 being disposed within the exhaust duct 7 while the sensors 26*o* and 27*o* being disposed outside of the dryer; 28, an inverter for controlling the rotational speed of the blower 11. The humidity sensors 26 and 26*o* detect relative humidity; a wet air diagram is stored in the memory 24; and a humidity difference ΔM for interrupting the drying operation can be preset by the setting device 25 (see FIG. 6). The humidity sensors 26 and 26*o*, the memory 24, and the CPU 21 together constitute an absolute humidity determining means.

The outer barrel 5 is formed with an opening for charging goods (such as clothes) 13 to be dried into the rotary drum 1. After the goods 13 to be dried have been charged into the rotary drum 1, the opening is tightly closed and then the rotary drum 1 is driven. High-temperature suction air which is heated by the heat exchanger 8 is forced by the blower 11 to pass through the rotary drum 1, thereby drying the goods 13. The suction air flows through a great number of pores formed through a cylindrical peripheral wall of the rotary drum 1 into the same, is humidified while flowing through the rotary drum 1, and is then discharged through the exhaust duct 7.

Figure 6:
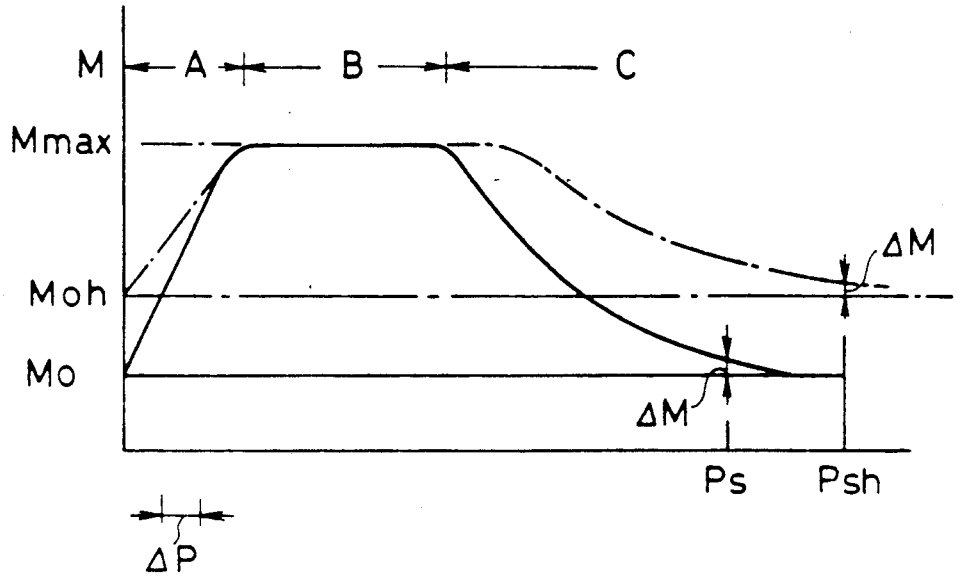
FIG. 6 is a graph schematically illustrating the relationship between a time P elasped after the starting of the drying operation and the absolute humidity M in the discharged air.

Referring next to FIG. 6, M represents the absolute humidity in the dryer, Mo represents the absolute humidity of the ambient air or surrounding atmosphere while the imaginary-line curve is obtained when the absolute humidity of the surrounding atmosphere is high (Mon) and the higher the humidity, the longer the drying time becomes.

Figure 7:
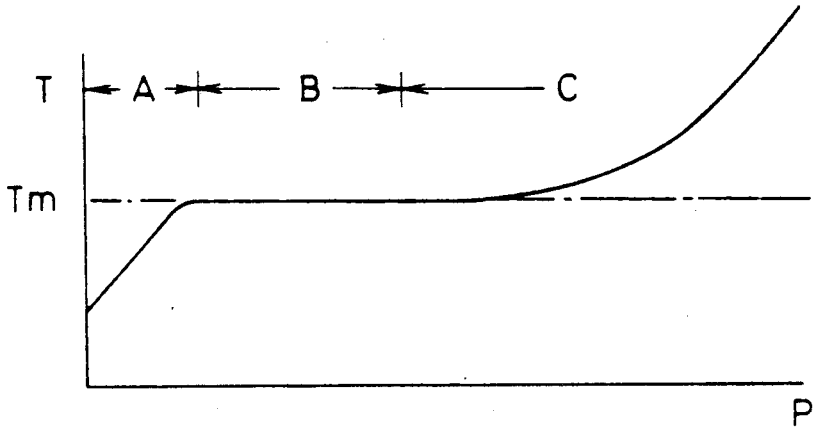
FIG. 7 is a graph schematically illustrating the relationship between the elased time P and the temperature T of the discharged air.

During a rising-time period A immediately after a starting of the drying operation, heat of the suction air is used to raise the temperature of water contained in the goods 13 to be dried and as shown in FIG. 7, a temperature T of the discharged air rises with the temperature rise thereof. During a constant or steady-state period B, the temperature T and the absolute humidity M (maintained at a level M max) of the discharged air are maintained substantially constant and the drying operation proceeds under the condition that the quantity of heat supplied and the quantity of evaporation are maintained in the balanced state. When water contents drop in the goods 13 being dried the, utilization efficiency of thermal energy begins to drop so that the absolute humidity M of the discharged air drops with the temperature rise T (during the damping period C). It will never happen that the absolute humidity M of the discharged air become lower than the absolute humidity Mo of the surrounding atmosphere.

Figure 5:
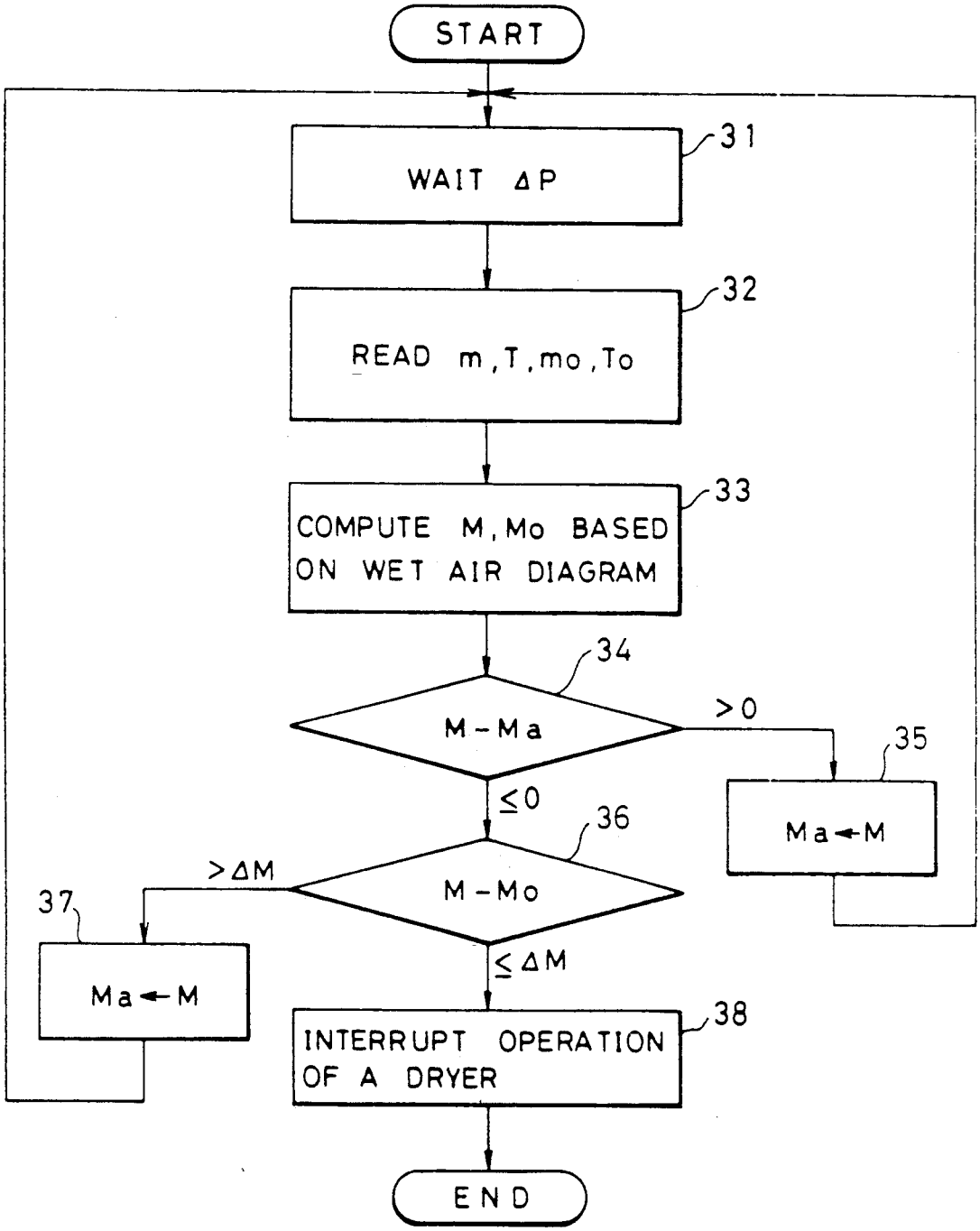
FIG. 5 is a flowchart illustrating one control procedure of the first embodiment shown in FIG. 1.

Referring next to the flowchart shown in FIG. 5, one control procedure of the first embodiment of the present invention will be described.

First, at the step 31 a measuring time interval ΔP for is determined detecting conditions of the discharged air (see FIG. 6) and at the step 32, the humidity m in the discharged air is detected by the humidity sensor 26, temperature T in the discharged air is detected by the temperature sensor 27, the humidity mo in the surrounding the atmosphere is detected by the humidity sensor 26*o* and temperature To in the surrounding atmosphere detected by the temperature sensor 27*o*, and are read into the memory 24. At a conversion step 33, the absolute humidity M in the discharged air as well as the absolute humidity Mo in the surrounding atmosphere are computed in response to the read-in data based on the wet air diagram stored in the memory 24. At a condition decision step 34, Ma represents the absolute humidity in the discharged air detected at a preceding measuring time and is initially zero. During the rising-time period A described above, $M-Ma>0$ so that a value Ma is renewed in the renews step 35 and the control procedure returns to the wait step 31. During the constant or steady-state period B and the damping period C, $M-Ma\leqq 0$ so that the control procedure advances from the condition decision step 34 to the stop decision step 36 at which a difference in absolute humidity in the discharged air and the surrounding atmosphere (M−Mo) is compared with a preset value ΔM. When absolute humidity M in the discharged air is higher than absolute humidity Mo in the surrounding atmosphere, the value Ma is renewed in the renewal step 37 and then the control procedure returns to the wait step 31. The difference in absolute humidity between the discharged air and the surrounding atmosphere (M−Mo) becomes less than the predetermined value ΔM; that is, when the drying operation time has passed a time point Ps or Psh shown in FIG. 6, the control procedure advances to a control step 38 so that the operation of the dryer is interrupted.

According to the present invention, the operation of the dryer is interrupted when the difference (ΔM') between absolute humidity M in the discharged air and absolute humidity Mo in the surrounding atmosphere (i.e., when approaching a rate (Mmax-M)/(Mmax-Mo) at which absolute humidity M in the discharged air approaches to absolute humidity Mo in the surrounding atmosphere) reaches a predetermined value, so that a desired degree of dryness of the goods can be attained without being adversely affected by variations of absolute humidity in the surrounding atmosphere.

Figure 8:
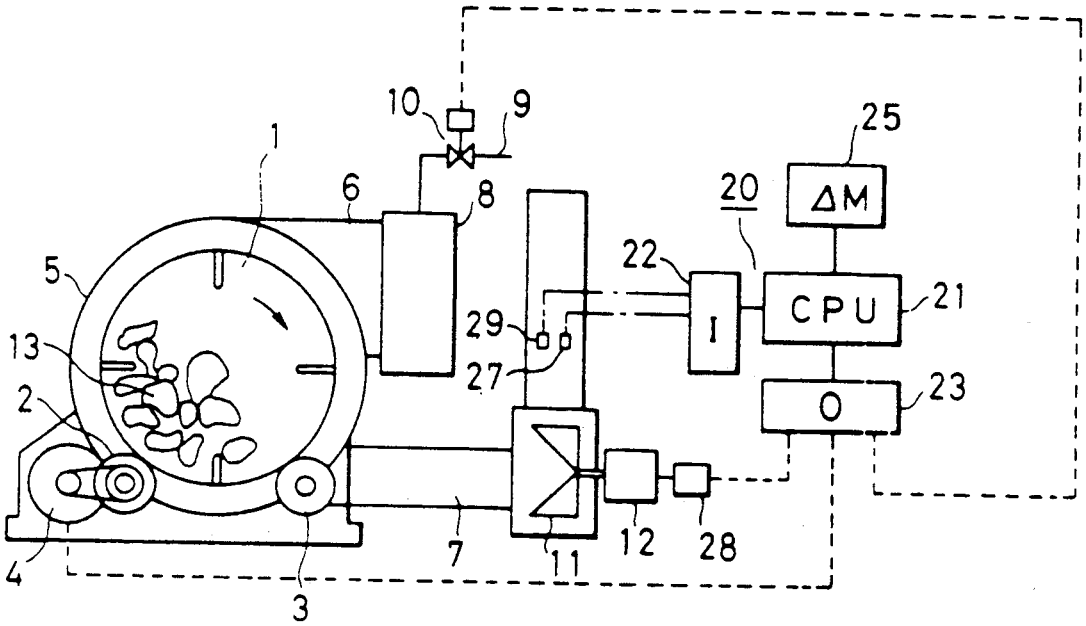
FIG. 8 is a schematic view of a second preferred embodiment of the present invention.
Figure 9:
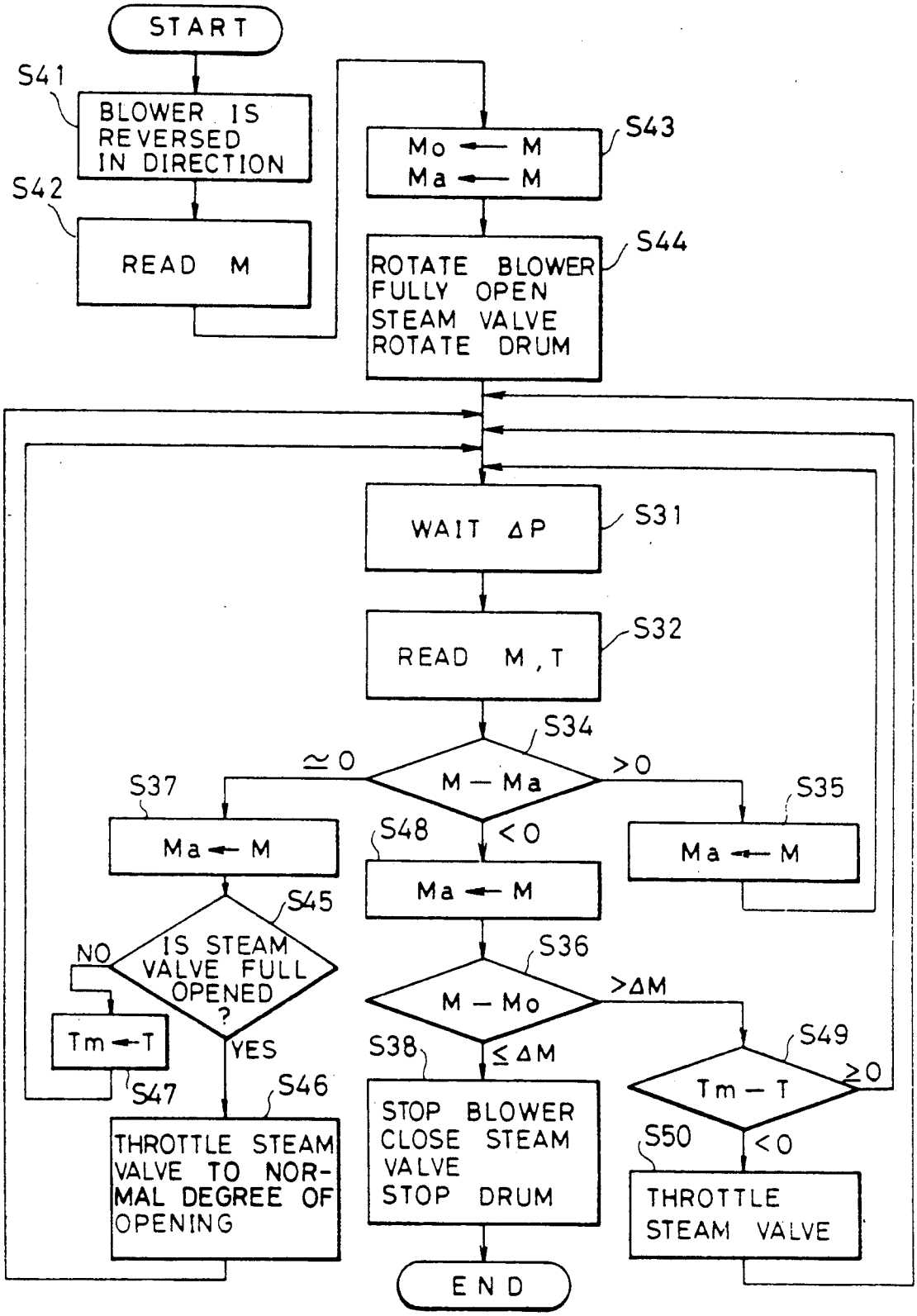
FIG. 9 is a flowchart showing one control procedure of the second embodiment shown in FIG. 8.

Referring next to FIGS. 8 and 9, a second preferred embodiment of the present invention and a method for controlling operation thereof will be described. In the second embodiment, an absolute humidity sensor is used as a humidity sensor 29 and the humidity sensor 29 and the temperature sensor 27 are disposed only in the exhaust duct 7 so that the humidity Mo in the surrounding atmosphere is detected at the start of operation of the dryer and is stored. The absolute humidity sensor 29 constitutes an absolute humidity determining means. During the operation, a degree of opening of the steam valve 10 is controlled also in response to a detected temperature T of the discharged air.

Next referring particularly to FIG. 9, at preparation steps 41–43, the blower 11 is reversed in direction to introduce the surrounding air into the exahust duct 7 and the humidity (absolute humidity) detected by humidity sensor 29 is read in as humidity Mo in the surrounding atmosphere and then the previously detected value Ma is read in. Thereafter at a start step 44, the steam valve 10 is fully opened to start the operation of the dryer. As in the case of the first embodiment, absolute humidity M and temperature T of the discharged air are detected at a measuring time interval ΔP predetermined at the wait step 31, are read in, and the control procedure advances to the condition decision step 34. Like the first embodiment, the control procedure returns from the condition decision step 34 through the renewal step 35 to the wait step 31. When the control procedure enters the constant or steady-state period B, M−Ma is approximately equal to 0 and then the control procedure advances from the renewal step 37 to a step 45 at which a degree of opening of the steam valve 10 is detected. Immediately after a transition from the rising time period A to the constant or steady-state period B, the control procedure advances to a control step 46 at which the steam valve 10 is throttled to a normal degree, for instance 20 % of opening. When the steam valve 10 is not fully opened, a detected temperature T is stored as a constant or steady-state temperature Tm at a temperature-setting step 47 and then the control procedure returns to the wait step 31. The stored constant or steady-state temperature Tm is used at step 49 which determines whether or not the steam valve 10 is throttled stepwise in the case of the operation control during the damping period C.

In the damping period C, $M-Ma<0$ and the control procedure advances through the renewal step 48 to the stop decision step 36. At step 36, if $M-Mo\leqq\Delta M$, the drying operation is interrupted at the control step 38 as in the case of the first embodiment. When $M-Mo>\Delta M$ and at the temperature-rise detection step 49 when a temperature T of the discharged air is higher than a constant or steady-state temperature Tm, the steam valve 10 is throttled, thereby preventing the temperature rise at an excessive rate (see the imaginary-line curve in FIG. 7).

According to the second preferred embodiment of the present invention, the rising-time period A can be shortened to be as short as possible so that the overall drying time can be shortened and so that the energy loss resulting from an oversupply of the thermal energy during the constant or steady-state period, and the damping or falling period, can be reduced. So far, it has been described that only the steam valve 10 is controlled, but it is to be understood that it is preferable to control a rotational speed of the blower 11 simultaneously with the control of the degree of opening of the steam valve 10. That is, the operation control is carried out in such a way that when the steam valve 10 is opened, the rotational speed of the blower 11 is increased, but when the steam valve 10 is throttled, the rotational speed of the blower 11 is decreased.

When goods to be dried are desired to be dried to a semidried state, it suffices, of course, to increase the predetermined value ΔM and instead of ΔM described above, the time when the drying operation is interrupted can be determined in response to the above-described approaching rate to the humidity in the surrounding atmosphere.

According to the present invention, the absolute humidity M in the discharged air is detected from time to time and in response to the differentiated or difference signal obtained from the absolute humidity thus detected, the transitions from the rising-time period A to the constant or steady-state period B and from the period B to the damping period C can be detected. As a result, the operation control can be carried out in such a way that, for instance, the quantity of heat transmitted to the suction air as well as the flow rate of the blower 11 are increased to maximum values, respectively, during the rise-time period A; the quantity of heat is decreased during the constant or steady-state period B; and then during the damping period C, the quantity of heat and the flow rate of air from the blower are sequentially decreased in response to the humidity drop so that the goods can be dried within a short period of time without wasting the energy.

Referring next to FIGS. 10–13, a third preferred embodiment of the present invention will be described.

Figure 10:
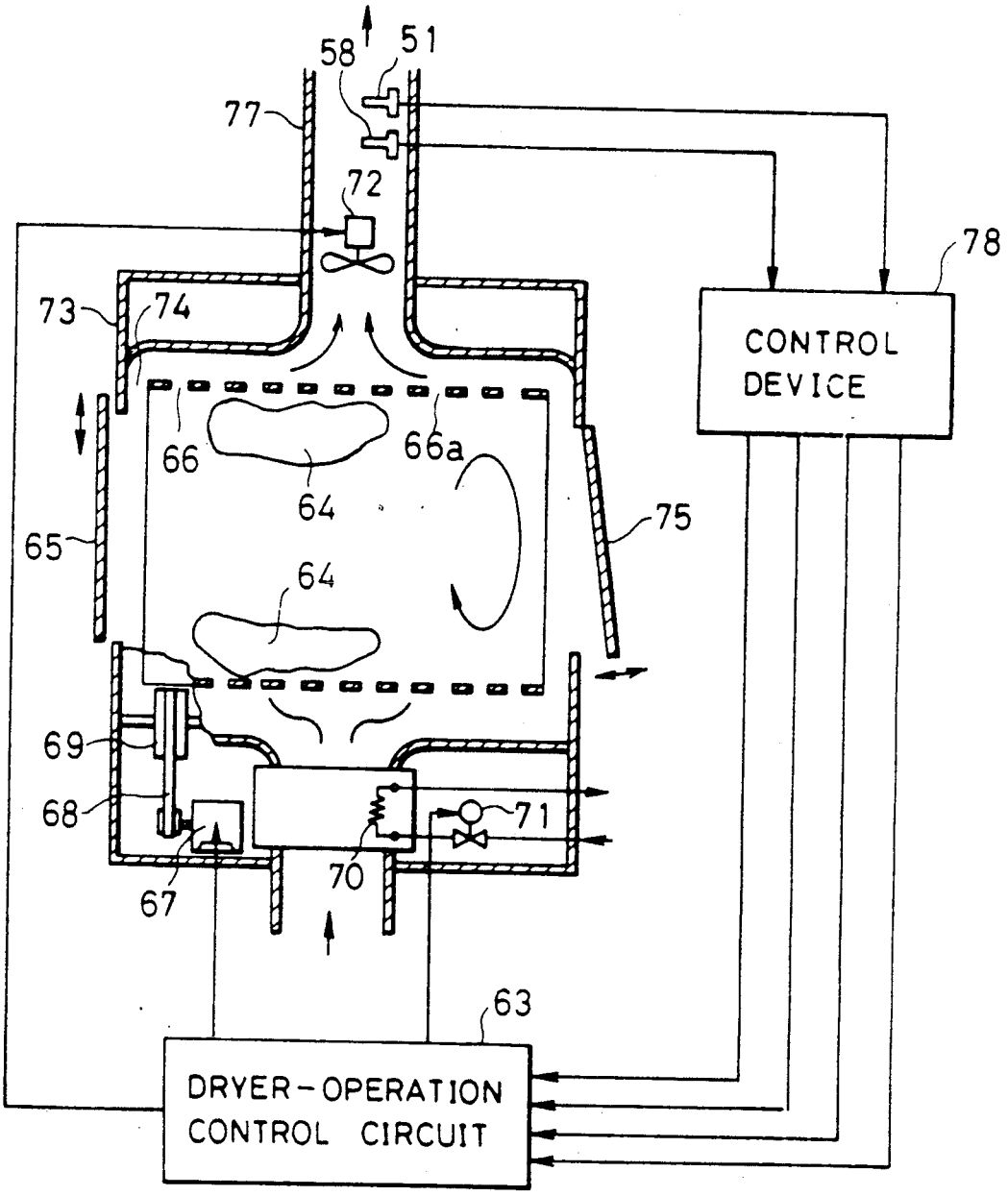
FIG. 10 is a schematic view of a third preferred embodiment of the present invention.

Referring first to FIG. 10 illustrating a vertical sectional view of the third embodiment, reference numeral 51 represents an absolute humidity sensor; which is an absolute humidity determining means 58, a temperature sensor; 63, a dryer-operation control circuit utilizing, for instance, a conventional relay circuit; 64, goods to be dried; 65, a door; 66, a rotary drum; 66*a*, air holes; 67, a motor for driving the rotary drum 66; 68, a driving belt; 69, driving roller; 70, a heater; 71, a steam valve; 72, a blower; 73, an outer walls or a shell; 74, air passages; 75, a door which is opened to remove dried goods out of the rotary drum 66; 77, an exhaust duct; and 78, a control unit. The absolute humidity sensor 51 and the temperature sensor 58 disposed within the exhaust duct 77 are connected to the control unit 78 so as to detect humidity and temperature of exhaust air. A signal for energizing or de-energizing the heat source, a drying operation instruction signal and a cooling operation signal all of which are the output signals from the control unit 78 are fed to the dryer-operation control circuit 63.

Figure 11:
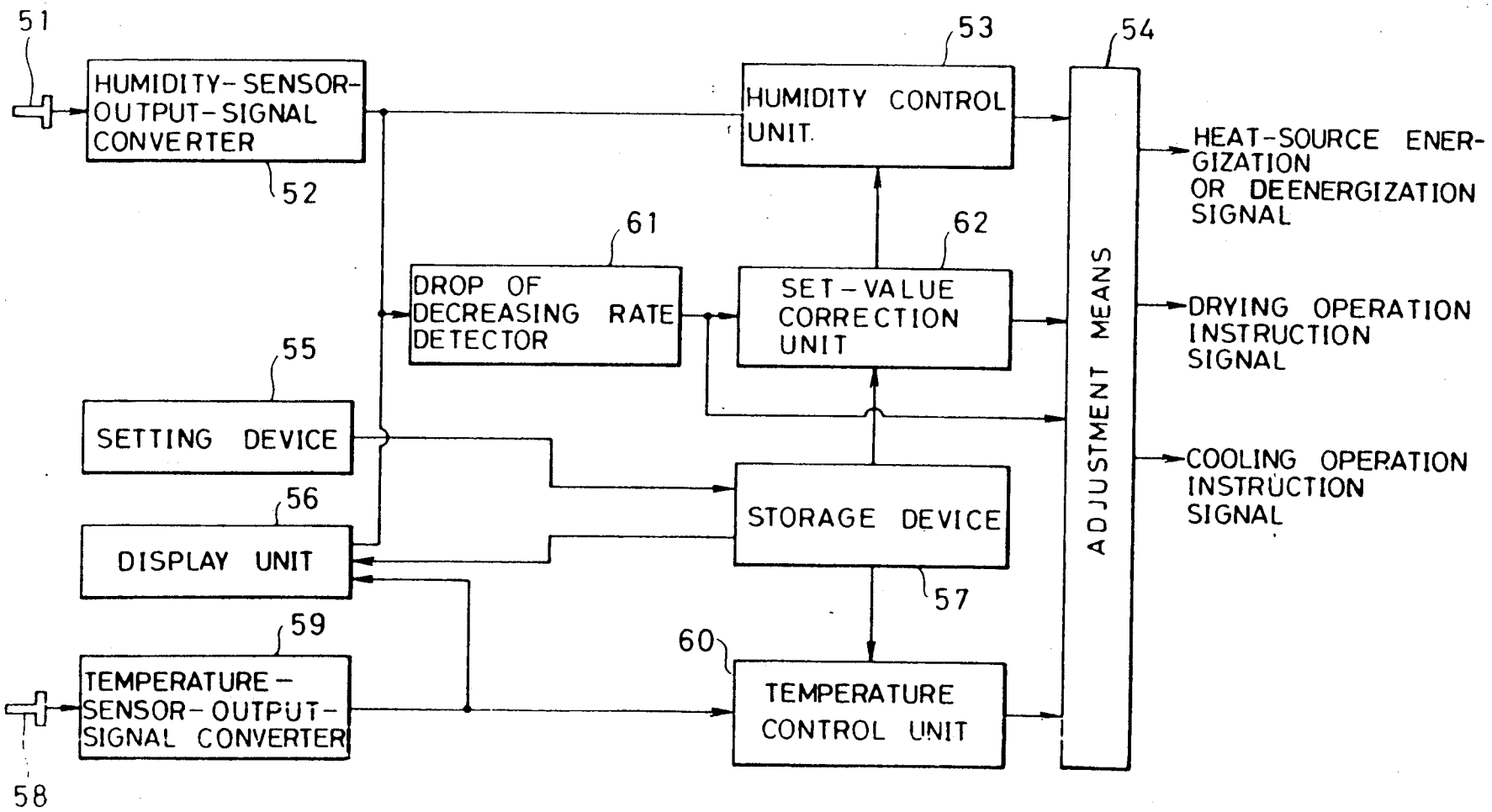
FIG. 11 is a block diagram illustrating in detail the functions of a control device for the third embodiment shown in FIG. 10.

The control unit 78 comprises a microcomputer as in the case of the embodiment shown in FIG. 1 or 8 and accomplishes various functions shown in the block diagram in FIG. 11.

Referring now to FIG. 11, reference numeral 51 represents an absolute humidity sensor; 52, a humidity-sensor-output-signal converter; 53, a humidity control unit; 54, an adjustment means; 55, a setting device; 56, a display unit; 57, a storage device; 58, a temperature sensor; 59, a temperature-sensor-output-signal converter; 60, a temperature control unit; 61, a detector for detecting the drop of an absolute-humidity decreasing rate; and 62, a set-value correction unit.

Next, the mode of operation of the third embodiment with the above-described construction will be described. The absolute humidity sensor 51 disposed in the exhaust duct 77 detects a degree of dryness of the goods to be dried and after an output signal from the sensor 51 is thermally corrected by the humidity-sensor-output-signal converter 52, it is fed into the humidity control unit 53. A predetermined degree of dryness (a set value of absolute humidity) which is preselected or preset by the setting device 55 depending upon materials of the goods to be dried is stored in the storage device 57 and is fed through the set-value-correction unit 62 to the humidity control unit 53, which in turn compares the set value of absolute humidity with absolute humidity detected by the absolute humidity sensor 51 and delivers the comparison output signal to the adjustment means 54.

In like manner, the temperature sensor 58 disposed in the exhaust duct 77 detects temperature of exhaust air and an output signal from the sensor 58 is thermally corrected by the temperature-sensor-output-signal converter 59 and then fed into the temperature control unit 60. A maximum allowable temperature rise preselected or preset by the setting device 55 and a cooling temperature which is also preselected or preset by the setting device 55 when the dryer must undergo the cooling process, are delivered through the storage device 57 to the temperature control unit 60, which in turn compares the predetermined maximum allowable temperature rise with temperature of the goods being dried (or to be dried) detected by the temperature sensor 58, and delivers the comparison output signal to the adjustment means 54. When the cooling process succeeds the drying process, the temperature control unit 60 also compares the set cooling temperature with temperature of the goods dried and delivers its comparison output signal to the adjustment means 54.

After the door 65 is opened, the goods 64 to be dried are charged into the rotary drum 66 through a conveyor or an operator. Simultaneously with a start of drying operation, the control unit 78 outputs a drying operation instruction signal and a signal for energizing or de-energizing the heat source so that in response to such output signals, the dryer-operation control circuit 63 feeds rotation instructions to the motor 67 for driving the rotary drum. The rotation of the motor 67 is transmitted through the driving belt 68 and the driving roller 69 to the rotary drum 66 so that the latter is rotated, whereby the goods 64 to be dried are tossed and tumbled therein. Concurrently, the driving control circuit 63 delivers instructions to the steam valve 71 so as to open the valve 71 to introduce steam, that is, thermal energy, into the heater 70 in order to heat suction air flowing therethrough into the rotary drum 66. Furthermore, it also delivers energization instructions to the blower or exhaust fan 72 installed adjacent to an inlet of the exhaust duct 77. Upon rotation of the blower 72, the suction air becomes hot while flowing through the heater 70 and flows into the rotary drum 66, thereby dehumidifying the goods 64 to be dried which are tossed and trumbled in the rotary drum 66. Thereafter the air flows through the air holes 66*a* of the rotary drum 66 and the air passages 74 defined between the rotary drum 66 and the outer walls 73 into the exhaust duct 77.

Figure 2:
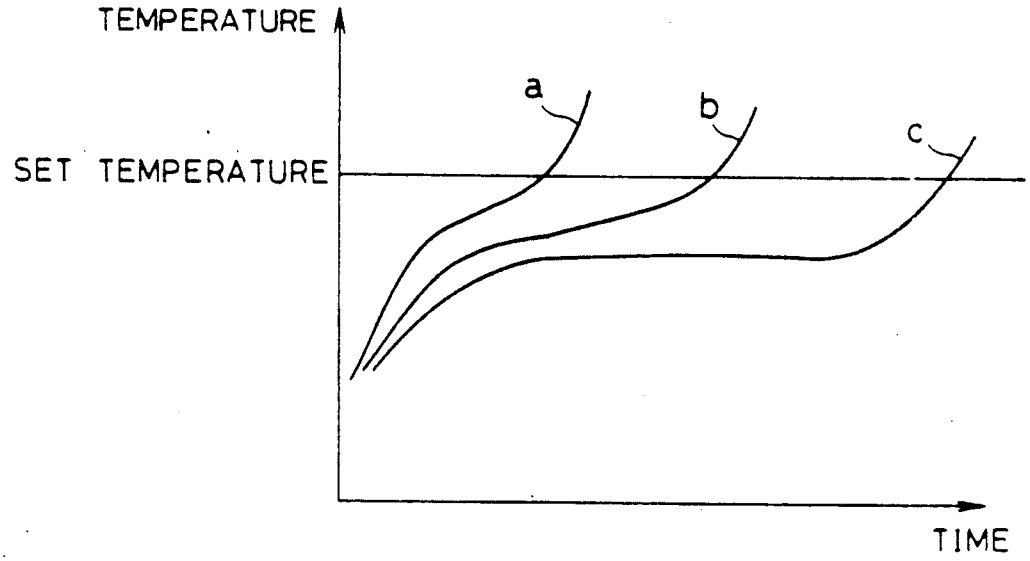
FIG. 2 is a diagram illustrating the relationship between the drying time and the temperature of the discharged air in a conventional dryer.
Figure 3:
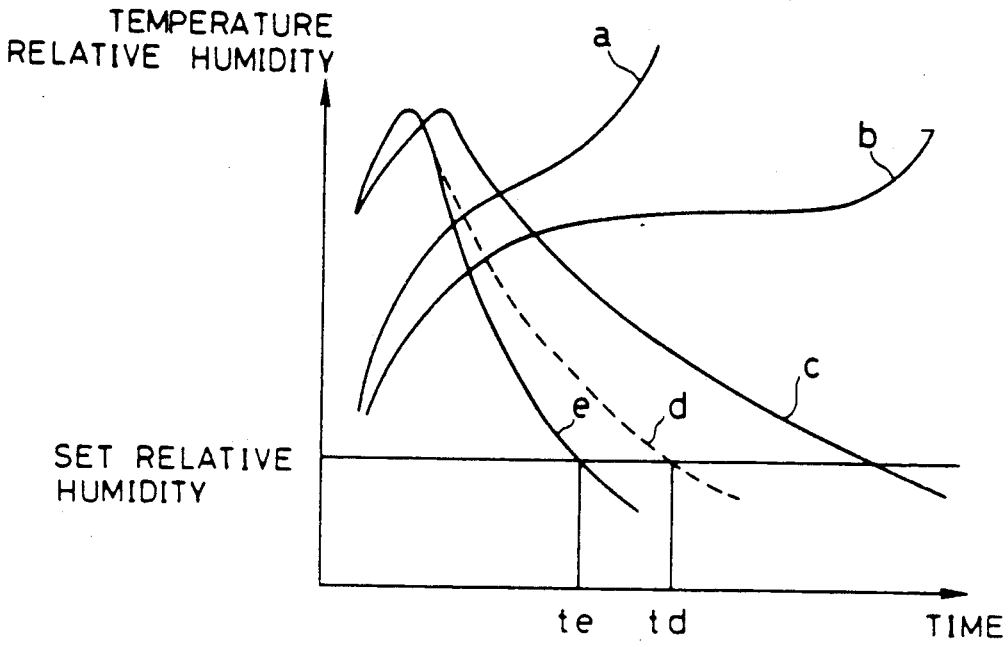
FIG. 3 is a diagram illustrating the relationships among the drying time, the temperature of the discharged air and the relative humidity thereof in the conventional dryer mentioned in FIG. 2.
Figure 4:
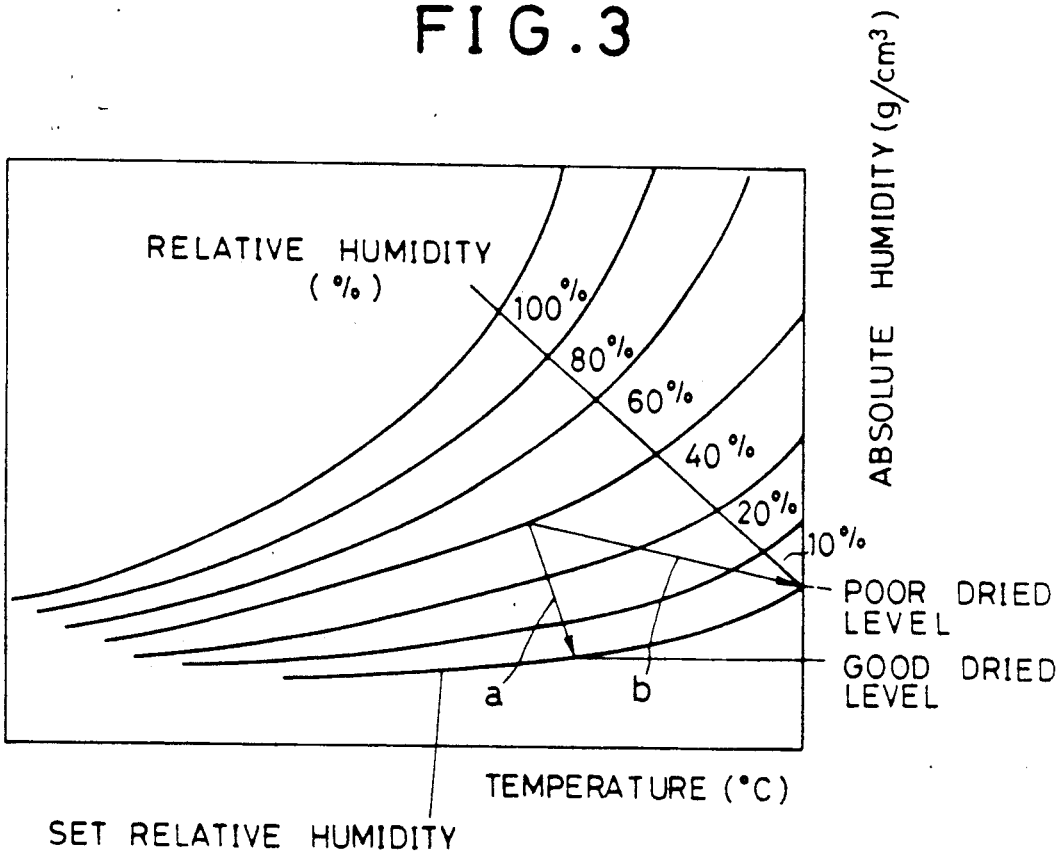
FIG. 4 shows the shift traces of goods heavy and light in weight, respectively, during the drying operation on an air diagram showing temperature, absolute humidity and relative humidity.
Figure 12:
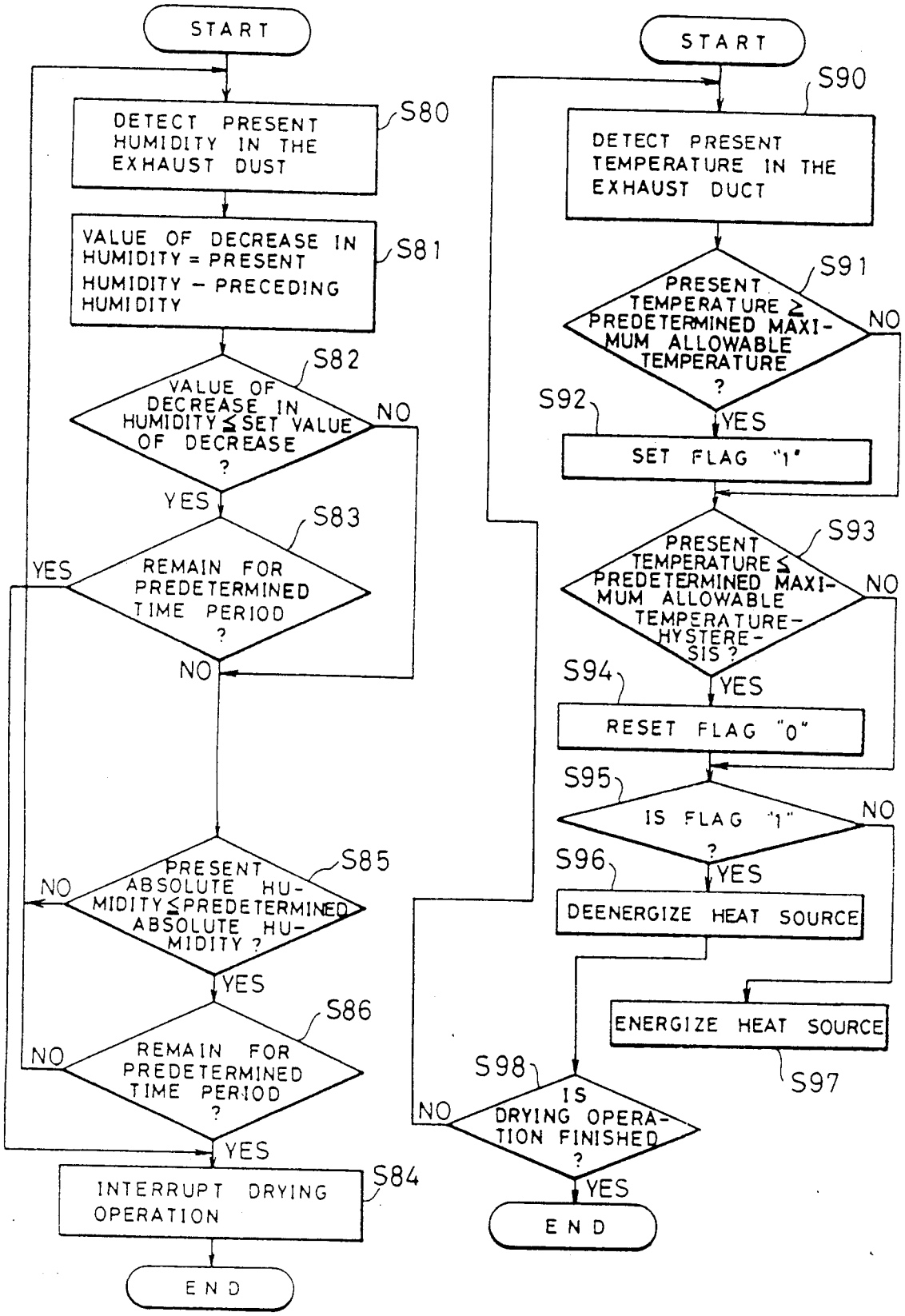
FIG. 12 is a flowchart illustrating one control procedure of the third embodiment shown in FIG. 10.

As the drying operation proceeds, temperature within the exhaust duct 77 exhibits the characteristics explained above with reference to FIG. 2. When the goods 64 to be dried are lighter than the rate weight of the dryer, the temperature rises as indicated by the curve a in FIG. 2. Referring now to FIG. 12, in the control unit 78, the present temperature of the discharged air is detected by the temperature sensor 58 installed in the exhaust duct 77 at the step 90 and at the next step 91, the present temperature detected at the step 90 is compared with a predetermined maximum allowable temperature previously determined depending upon the materials of the goods 64 to be dried. When the present temperature is higher than the predetermined maximum allowable temperature, a flag is set to "1" at the step 92 and at the step 93 the present temperature and the predetermined maximum allowable temperature minus a hysteresis width are compared with each other. When the present temperature is lower than the predetermined maximum allowable temperature minus a hysteresis width, the control procedure advances to the step 94 at which the flag is reset to "0". At the step 95 whether the flag is set to "1" or reset to "0" is detected and when the flag is detected in the state of "1", a signal for de-energizing the heat source is delivered to the driving control circuit 63 at step 96. In response to the de-energization signal, the dryer-operation control circuit 63 delivers a shut-off signal to the steam valve 11, thereby closing the same. On the other hand, when the flag is detected in the state of "0", the control unit 78 delivers a signal for energizing the heat source to the dryer-operation circuit 63 at the step 97. When the temperature sensor 58 detects temperature drops to a predetermined temperature blind sector $\Delta T°$ C., the control unit 78 delivers again the energization signal to the dryer-operation control circuit 63. Thereafter the above-described control procedure is repeated until the drying operation is finished so that the goods 64 are dried by hot air and consequently not only does the degree of drop of the goods 64 being dried, but also the absolute humidity in the exhaust duct 77 drops.

Meanwhile at the step 80, the absolute humidity is detected by the absolute humidity sensor 51 disposed in the exhaust duct 77 and at the step 85, it is determined whether the present absolute humidity thus detected is lower than a predetermined set value of absolute humidity. At the step 86, it is determined whether or not the present absolute humidity detected which is lower than the predetermined set value of absolute humidity remains for a predetermined time period. At the steps 85 and 86, when it is determined that the detected absolute humidity reaches the predetermined set value of absolute humidity and remains at the latter degree for a predetermined time interval, the control unit 78 delivers the signal for interrupting the drying operation and the signal for de-energizing the heat source and in response to such signals, the dryer-operation control circuit 63 closes the steam valve 71 and de-energizes the rotary-drum driving motor 67 and the blower 72, whereby the drying operation is interrupted. When the cooling process succeeds the drying process, the control unit 78 delivers the signal for starting the cooling process in response to which the dryer-operation control circuit 63 closes only the steam valve 71 and continues the energization of rotary-drum driving motor 67 and the blower 72 and furthermore opens the door 65 in order to supply the cool air into the rotary drum 66. Since the heat source is now de-energized and the door 65 is kept opened to supply the cool air into the rotary drum 66, temperature of the dried goods 64 quickly drops simultaneously with the quick temperature drop within the exhaust duct 77. When the temperature in the exhaust duct 77 is detected to have dropped to a predetermined cooling temperature, the control unit 78 outputs the signal for interrupting the cooling operation in response to which the dryer-operation control circuit 63 de-energizes not only the rotary-drum driving motor 67 but also the blower 72 and opens the discharge door 75 so that the dried and cooled goods 64 can be removed out of the rotary drum 66.

Figure 13:
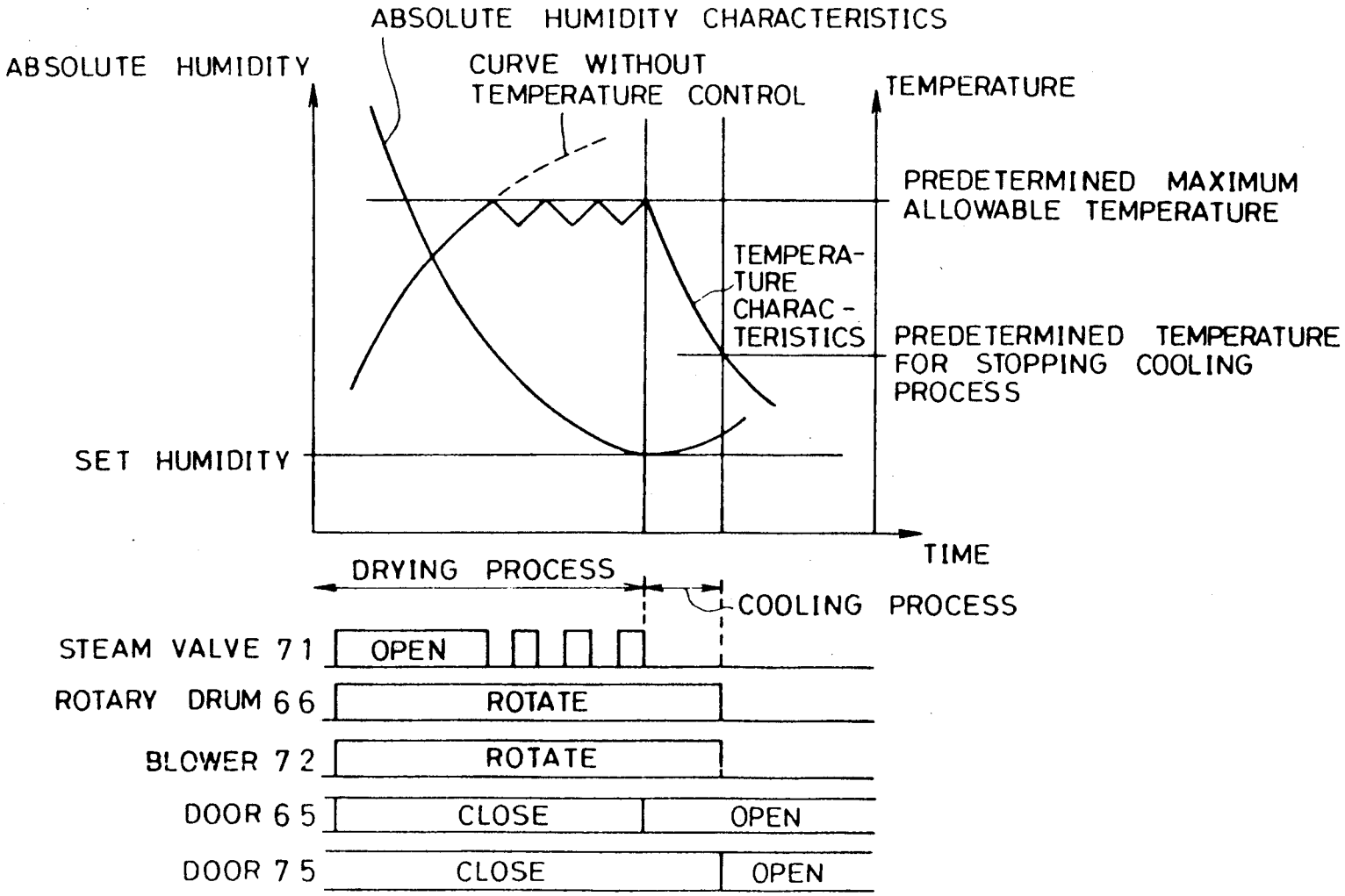
FIG. 13 is a view used to explain the control operation on the third embodiment shown in FIG. 10.

FIG. 13 is a view used to explain the mode of operation of the dryer in accordance with the present invention controlled in the manner described above and shows a characteristic diagram in which absolute humidity and temperature in the exhaust duct 77 are plotted with respect to time and includes a time chart illustrating the operation of major component parts such as the rotary-drum driving motor 67, the blower 72, the steam valve 71 and so on.

Figure 14:
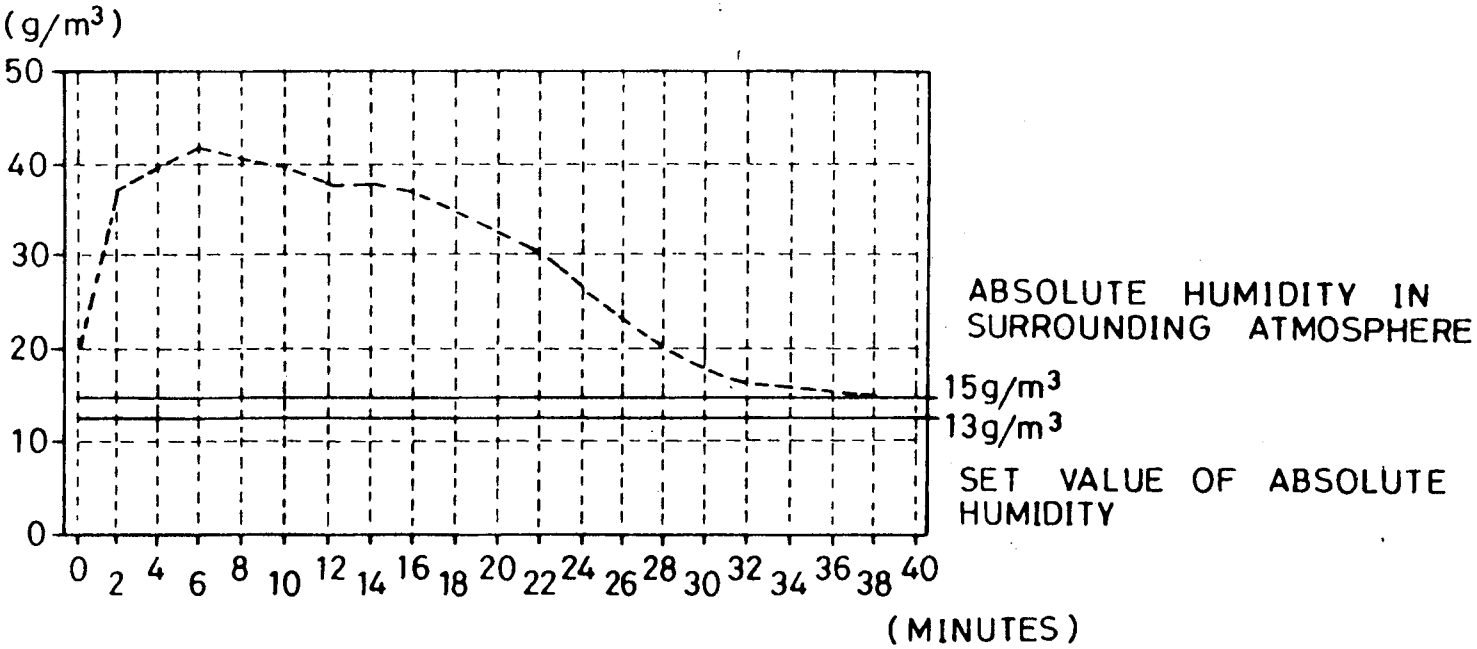
FIG. 14 is a diagram illustrating the relationship between the drying time and the absolute humidity in the discharged air when a predetermined absolute humidity is lower than the absolute humidity of the surrounding atmosphere.

The degree of dryness of the goods 64 to be dried is detected by the absolute humidity sensor 51 and exhibits the following characteristics as time elapses. During the initial stage of the drying operation, the degree of dryness increases gradually and becomes substantially flat during the intermediate stage and steadily decreases during the terminal stage. However, when absolute humidity of the surrounding air which is sucked into the dryer is in excess of a set value of absolute humidity, the dryness-time characteristic curve during the terminal stage drops at a drop rate approaching an asymptote which is the set value of absolute humidity in the surrounding atmosphere and will not intersect the set value or level of absolute humidity. It follows, therefore, that in the system for interrupting the drying operation when the absolute humidity detected in the manner described above drops below the set value of absolute humidity, when the absolute humidity in the suction air is higher than the set value of absolute humidity, the absolute humidity detected will not reach the set value of absolute humidity in principle even if the drying operation time is increased infinitely. FIG. 14 shows an absolute humidity characteristic when the absolute humidity in the surrounding atmosphere is 15 $g/m^3$ and the set value of absolute humidity is 13 $g/m^3$. As seen, the frequency that the absolute humidity in the surrounding atmosphere becomes in excess of the set value of absolute humidity is low, but it is considered that the absolute humidity in the surrounding atmosphere in excess of the set value of absolute humidity is observed when the drying operation is started for the first time in the morning or during the rainy season. Especially in linen supply factories, there is a tendency toward complete automation from washing process to drying process without any attending operator so that the whole operation is very adversely affected if there are no means for preventing the absolute humidity in the surrounding atmosphere from becoming in excess of the set value of absolute humidity even if the frequency of such phenomenon is low.

Based on the time characteristic shown in FIG. 14 when the absolute humidity in the surrounding atmosphere is higher than the set value of absolute humidity, according to the present invention, the decrease in the drop rate of a degree of absolute humidity detected by the absolute humidity sensor 51 is detected so that the absolute humidity in the surrounding atmosphere is determined higher than the set value of absolute humidity, thereby correcting the set value of absolute humidity in excess of the absolute humidity in the surrounding atmosphere or forcibly interrupting the drying operation.

To this end, as shown in FIG. 11, the present invention provides a detector 61 for detecting the drop of decreasing rate of the absolute humidity detected by the absolute humidity sensor 51 and a unit 62 for correcting the set value as described before. When the absolute humidity in the surrounding atmosphere is higher than the set value of absolute humidity, the output from the humidity-sensor-output-signal converter 52 is delivered to the detector 61 for detecting the drop of decreasing rate indicated by time characteristic of the detected humidity in the terminal stage of the drying operation. At the step 81 shown in FIG. 12, the detector 61 obtains a value of decrease in humidity by executing following arithmetic operation.

A value of decrease in humidity is equal to a present value of humidity minus a value of humidity detected at the immediate preceding measuring time point. At step 82, the value of decrease in humidity thus obtained is compared with a set value of decrease, thereby determining a drop of decreasing rate of the absolute humidity detected. At the step 83, whether or not the time when the value of decrease in humidity obtained at the step 81 is lower than the set value of decrease continues in excess of a predetermined time period is determined and when the value of decrease in humidity lower than the set value of decrease continues in excess of the predetermined time period, at the step 84 the detector 61 feeds a force interruption signal directly into the adjustment means 54 so that the drying operation instruction signal outputted from the adjustment means 54 is changed into the interruption signal, thereby forcibly interrupting the drying operation.

Figure 12A:
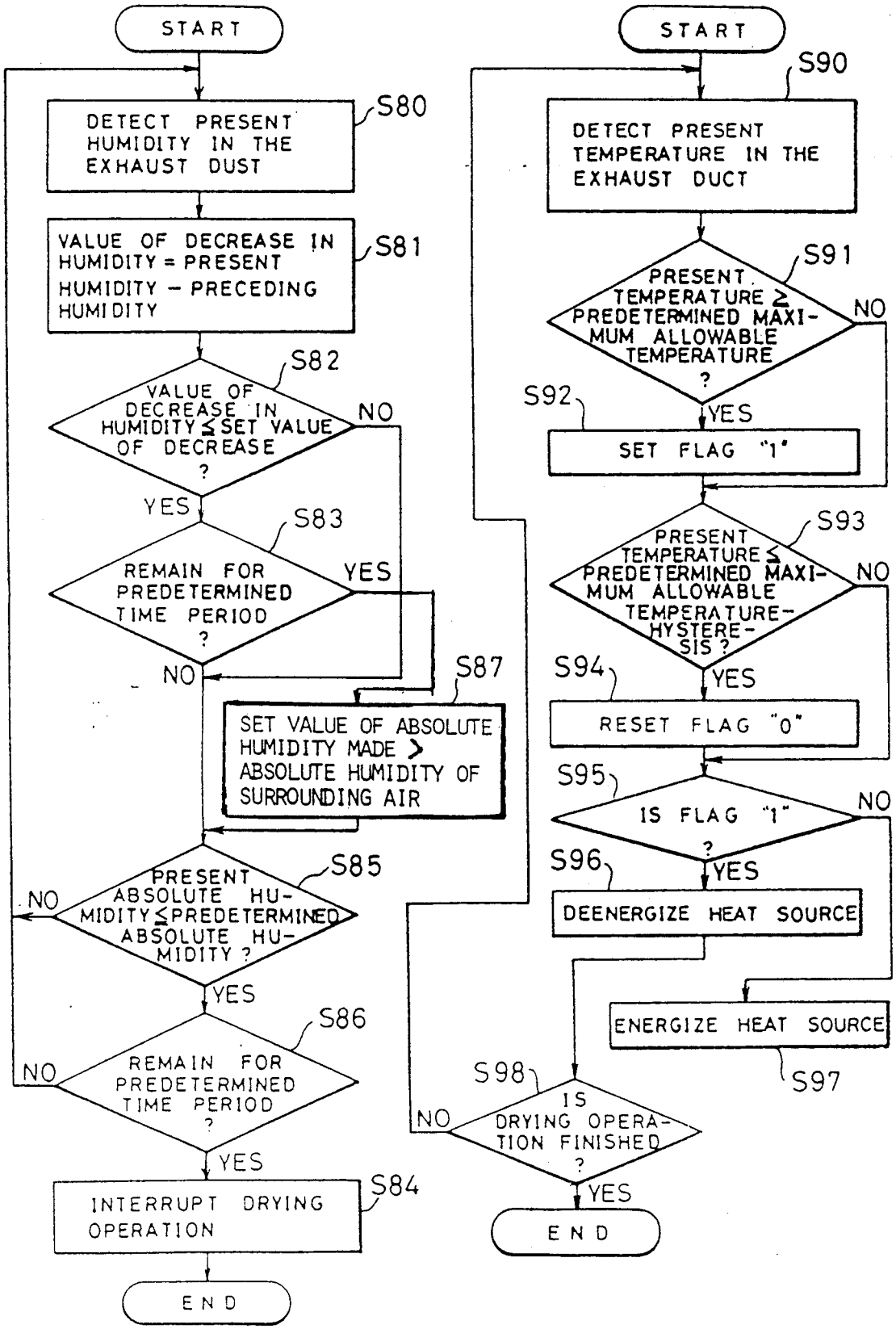
FIG. 12A is a flow chart illustrating an alternative to the control procedure of FIG. 12.

Alternatively, referring to FIG. 12A, when a drop of the rate of the humidity is determined at the step 82, and the drop is determined to have continued in excess of the predetermined time interval at the step 83, this signal is fed into the correction unit 62 for correcting the set value. At the step 87 the set value of absolute humidity predetermined in accordance with the materials of the goods to be dried in the storage device 57 is temporarily corrected to a value higher than the value of absolute humidity in the surrounding atmosphere and the corrected set value is fed into the humidity control unit 53.

The humidity control unit 53 compares, in like manner described above at the step 85, the humidity of the goods being dried, detected by the absolute humidity sensor 51 with the corrected value of humidity inputted into the control unit 53 through the unit 62 and delivers a comparison output signal to the adjustment means 54.

The adjustment means 54 receives the humidity control signal delivered from the humidity control unit 53, the temperature control signal derived from the temperature control unit 60 and the force interruption signal outputted from the decreasing rate drop detector 61 and delivers the heat-source energization or de-energization signal consisting of a series relationship between the humidity control signal and the temperature control signal, the drying operation instruction signal and the cooling operation instruction signal or the drying operation interruption signal consisting of a parallel relationship between the humidity control signal and the forced interruption signal to the dryer operation control circuit 63.

By means of the display unit 56, a predetermined temperature and a predetermined humidity, both of which are determined depending upon the materials of the goods to be dried and are stored in the storage device 57, and other various control data such as a blind sector data and so on can be monitored and, furthermore, the detected humidity and temperature and respective steps of the drying operation can be monitored.

Figure 15:
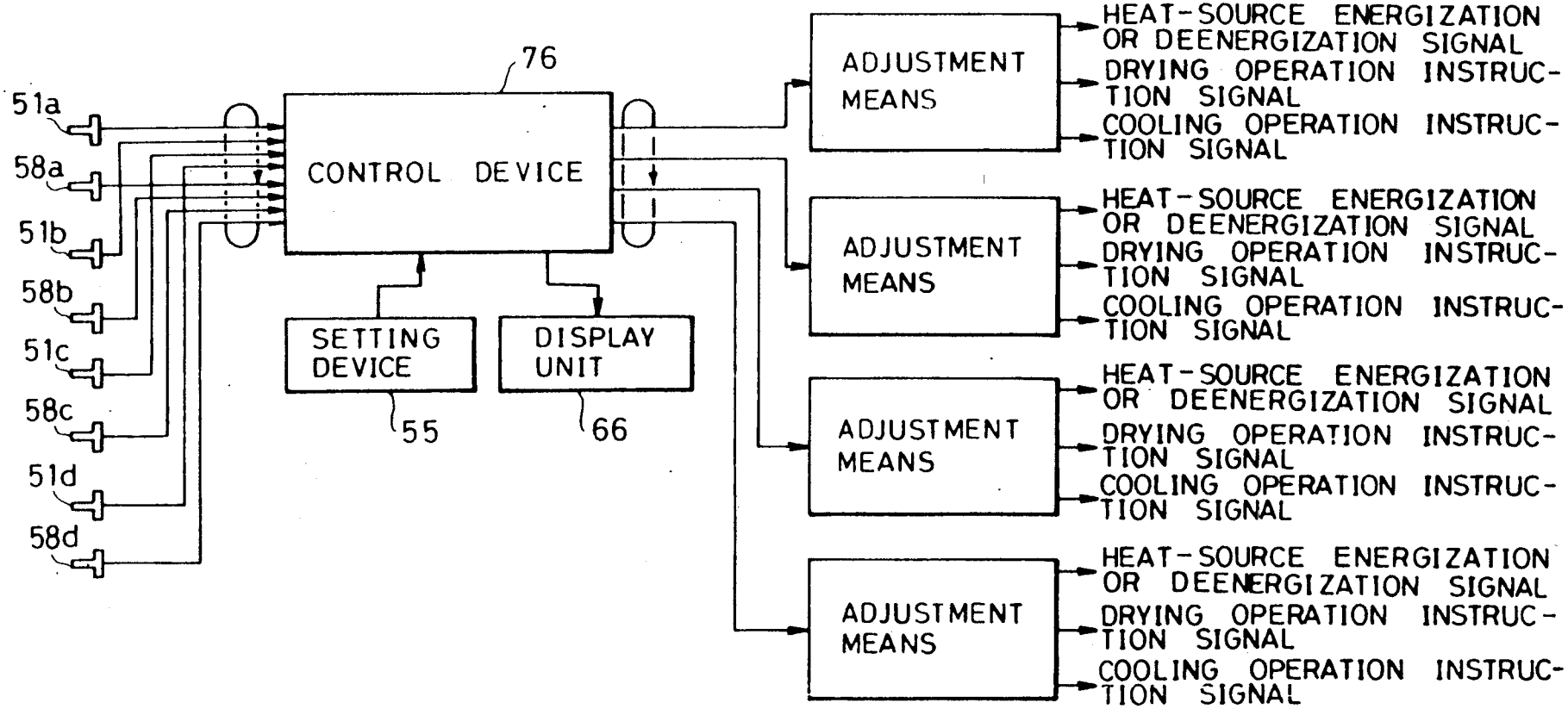
FIG. 15 is a schematic block diagram of a fourth preferred embodiment of the present invention.

FIG. 15 is a block diagram of a fourth preferred embodiment of the present invention in which sensors and adjustment means are arranged independently to each other for, for instance, four dryers, while a single control unit 76 is provided in common for the four dryers so that respective dryers can be controlled in a time sharing manner by the single control unit 76.

In FIG. 15, an absolute humidity sensor 51*a* and a temperature sensor 58*a* are disposed for a first dryer; an absolute humidity sensor 51*b* and a temperature sensor 58*b*, for a second dryer; an absolute humidity sensor 51*c* and a temperature sensor 58*c*, for a third dryer; and an absolute humidity sensor 51*d* and a temperature sensor 58*d*, for a fourth dryer, respectively. In like manner, adjustment mans 54*a*, 54*b*, 54*c* and 54*d* are provided for four dryers, respectively. The control unit 76 performs the time sharing control of the four dryers by scanning the sensors and adjustment means thereof. When the control is accomplished in common for the four dryers, the overall control device can be reduced in cost. In FIG. 15, reference numeral 55 denotes a setting unit; and 56, a display unit.

The invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A dryer comprising:

a container for holding goods to be dried therein;

a suction duct and an exhaust duct both of which are communicated with said container;

means for blowing the surrounding air through said suction duct, said container and said exhaust duct in the order named;

means for heating air flowing through said suction duct;

means for measuring the degree of absolute humidity in exhaust air flowing through said exhaust duct at a predetermined time interval;

means for presetting a predetermined value of absolute humidity;

means for comprising the degree of absolute humidity in the exhaust air measured by said absolute humidity measuring means with said predetermined value of absolute humidity;

means for interrupting the drying operation of said dryer when a comparison result output derived from said comparison means has a predetermined relationship;

means for determining a drop of decreasing rate of absolute humidity measured by said absolute humidity measuring means;

means for determining the absolute humidity of the surrounding air; and means for correcting said predetermined value of absolute humidity to a value higher than the absolute humidity in the surrounding air in response to an output signal derived from said drop determining means.

2. A dryer as claimed in 1, further comprising means for detecting the temperature of the exhaust air flowing through said exhaust duct; and means, responsive to an output temperature signal derived from said temperature detecting means, for controlling said heating means in such a way that the temperature of the goods being dried is prevented from rising in excess of a maximum allowable temperature.

3. In a method for controlling the operation of a dryer of the type comprising a container for holding goods to be dried therein, a suction duct and an exhaust duct both of which are communicated with said container, an air blower for forcing the surrounding air to flow through said container, a heater for heating suction air, first absolute humidity measuring means for measuring the degree of absolute humidity in the exhaust air flowing through said exhaust duct and second absolute humidity measuring means for measuring the absolute humidity of the surrounding air, said method for controlling the operation of said dryer comprising the steps of:

measuring the degree of absolute humidity in the exhaust air by said first absolute humidity measuring means for a predetermined time interval;

measuring the degree of absolute humidity in the surrounding air by said second absolute humidity measuring means;

interrupting the drying operation of said dryer when said measured degree of absolute humidity in the exhaust air and a predetermined value of absolute humidity have a predetermined relationship;

determining a drop of decreasing rate of absolute humidity in the exhaust air measured by said first absolute humidity measuring means; and automatically correcting said predetermined value of absolute humidity in the exhaust air to a value higher than the absolute humidity in the surrounding air in response to an output signal derived from said drop determining step.

4. A method for controlling operation of a dryer as claimed in claim 3, further comprising:

the step of measuring the temperature of said goods to be dried; and the step of controlling said heater in response to an output temperature signal derived from said temperature measuring step in such a way that the temperature of said goods being dried is prevented from rising in excess of a maximum allowable temperature.

5. A dryer comprising:

a container for holding goods to be dried therein;

a suction duct and an exhaust duct both of which are communicated with said container;

means for blowing the surrounding air through said suction duct, said container and said exhaust duct in the order named;

means for heating air flowing through said suction duct;

means for measuring the degree of absolute humidity in exhaust air flowing through said exhaust duct at a predetermined time interval;

means for presetting a predetermined value of absolute humidity;

means for comparing the degree of absolute humidity in the exhaust air measured by said absolute humidity measuring means with said predetermined value of absolute humidity;

means for interrupting the drying operation of said dryer when a comparison result output derived from said comparison means has a predetermined relationship;

means for determining a drop of decreasing rate of absolute humidity measured by said absolute humidity measuring means; and means for interrupting the drying operation of said dryer in response to an output signal derived from said drop determining means.

6. A dryer as claimed in claim 5, further comprising means for detecting the temperature of the exhaust air flowing through said exhaust duct; and means, responsive to an output temperature signal derived from said temperature detecting means, for controlling said heating means in such a way that the temperature of the goods being dried is prevented from rising in excess of a maximum allowable temperature.

7. In a method for controlling the operation of a dryer of the type comprising a container for holding goods to be dried therein, a suction duct and an exhaust duct both of which are communicated with said container, an air blower for forcing the surrounding air to flow through said container, a heater for heating suction air, and means for measuring the degree of absolute humidity in exhaust air flowing through said exhaust duct, said method for controlling operation of said dryer comprising the steps of:

measuring the degree of absolute humidity in the exhaust air by said absolute humidity measuring means for a predetermined time interval;

interrupting the drying operation of said dryer when said measured degree of absolute humidity and a predetermined value of absolute humidity have a predetermined relationship;

determining a drop of decreasing rate of absolute humidity measured by said absolute humidity measuring means; and interrupting the operation of said dryer in response to an output signal derived from said drop determining step.

8. A method for controlling the operation of a dryer as claimed in claim 7, further comprising:

the step of measuring the temperature of said goods to be dried; and the step of controlling said heater in response to an output temperature signal derived from said temperature measuring step in such a way that the temperature of said goods being dried is prevented from rising in excess of a maximum allowable temperature.

* * * * *

UNITED STATES PATENT AND TRADEMARK OFFICE

CERTIFICATE OF CORRECTION

PATENT NO. : 5,050,313

DATED : September 24, 1991

INVENTOR(S) : WAKAEYA ET AL.

It is certified that error appears in the above-identified patent and that said Letters Patent is hereby corrected as shown below:

On the title page, Item

-- [75] Inventors: Shinji Wakaeya and Shozo Shionome, both of Kawasaki, Japan --

Signed and Sealed this

Thirtieth Day of March, 1993

*Attest:*

STEPHEN G. KUNIN

*Attesting Officer*

*Acting Commissioner of Patents and Trademarks*